United States Patent [19]

MacDonald et al.

[11] Patent Number: 5,000,451

[45] Date of Patent: Mar. 19, 1991

[54] GAME BALL

[76] Inventors: Richard A. MacDonald, 504 Baywood Dr., Cape May, N.J. 08204; James A. MacDonald, 414 Garden State Pkwy., Cape May, N.J. 08210

[21] Appl. No.: 480,208

[22] Filed: Feb. 14, 1990

[51] Int. Cl.[5] ..... A63B 39/06; A63B 43/00; A63B 37/14

[52] U.S. Cl. ..... 273/65 EC; 273/65 EF; 273/DIG. 20; 273/58 F

[58] Field of Search ..... 273/65, 58 F, 58 H, 273/58 K, 58 A, 58 B, 58 BA, 58 E, 428

[56] References Cited

U.S. PATENT DOCUMENTS

| | | | |
|---|---|---|---|
| 3,450,407 | 6/1969 | Russo | 273/65 EC |
| 4,917,381 | 4/1990 | Spector | 273/65 EC |

*Primary Examiner*—George J. Marlo

*Attorney, Agent, or Firm*—Epstein, Edell & Retzer

[57] ABSTRACT

A football or other projectile is stabilized in flight by weighted material that responds to spinning of the football about its major axis by moving radially outward to become evenly distributed about that axis. In a preferred embodiment, two annular tubes, concentrically disposed about the major axis, encircle the ball at opposite sides of a plane containing the minor axis of the ball. The weighted material, in the form of beads, liquid, etc., is contained within the tubes and is flung radially outward as the ball spins.

20 Claims, 1 Drawing Sheet

10
12
14

34
36
38
32
12
18

38
34
32
3
18
36
26
34
16
28
12
20
30
24
22
38
36
3
14

36
18
34

34
40
18
32

34
40
18

GAME BALL

BACKGROUND OF THE INVENTION

1. Field of the Invention

The invention broadly pertains to a projectile and, in particular, to a game ball such as a football. More specifically, the invention relates to a game ball having increased rotational stability and a longer flight path when thrown through the air.

2. Description of the Prior Art

The accuracy and distance for a hand thrown projectile is difficult to predict, being dependent upon the control of the projectile in the hand of the individual throwing or hurling the projectile into the air. A projectile such as a football, having a longitudinal axis longer than its lateral axis, is particularly difficult to control and must be perfectly thrown to rotate or spin about its longitudinal axis in order to obtain maximum distance and precision in reaching its target. The physical coordination required in accurately throwing a football forecloses the sport of passing a football from the average person who is relatively unskilled in the football passing technique.

Prior art efforts toward enhancing the accuracy and flight path for a thrown projectile have involved channeling air through a central constriction in a longitudinal passage formed in the body of the projectile so that the projectile adjusts itself when thrown to rotate about its longitudinal axis. U.S. Pat. No. 3,884,466 to MacDonald et al, for example, discloses a game ball having a venturi-like passage formed therein extending along the longitudinal axis. When the ball is thrown, air is channeled through a constricted opening located midway along the length of the passage to cause the ball to rotate about the longitudinal axis. Rotation of the ball minimizes air resistance and permits the ball to be thrown greater distances with improved accuracy. Momentum and stability for the ball is obtained by a cylindrical band of metal embedded in the ball in alignment with the lateral axis. Similarly, U.S. Pat. No. 4,003,574 to MacDonald et al is directed to a game ball having a longitudinal venturi-like nozzle passageway and a plurality of weighted elements located within or adjacent an outer wall of the ball to provide rotational stability for the ball.

Additionally, U.S. Pat. No. 2,364,247 to Shearer teaches a collapsible bladder inflated within a ball and centered therein by radial tie members to establish an axis of rotation about which the ball is steadied when thrown through the air.

The use of a gyroscope for obtaining a spiral pass is disclosed in U.S. Pat. No. 3,700,239 to Patrick et al. The latter patent discloses a football having a gyroscope mounted within its shell. The axis of rotation of the gyroscope must be perfectly coincident with the longitudinal axis of the football to obtain an accurate path of travel for the ball.

The foregoing game balls rely upon the exact symmetrical placement of the stabilizing components within the ball. Thus, the need exists for a game ball having stabilizing means which is automatically self-implementing and self-adjusting, and not dependent upon the precise placement of the stabilizing means within the game ball during the manufacturing process and during use. The need exists, therefore, for a game ball having stabilizing means which is virtually independent of any possible inaccuracies in the manufacturing process while providing reliable and effective rotational stability and increased flight paths over continued use.

SUMMARY OF THE INVENTION

Accordingly, it is an object of the invention to construct a projectile capable of being thrown great distances with increased accuracy.

It is a further object of the invention to provide a projectile with means causing the projectile to rotate about its longitudinal axis when thrown through the air.

An additional object of the invention is to provide stabilizing means for a projectile to automatically straighten the projectile so that its longitudinal axis is aligned with the direction of throw.

Another object of the invention is to construct a projectile with flight stabilizing means for causing the projectile when thrown to rotate in a true spiral.

A further object of the invention is to provide a projectile stabilized by weight means movably mounted to be automatically distributed evenly about the longitudinal axis of the projectile when the projectile is thrown through the air.

An additional object of the invention is to provide a projectile having weight means adapted to be directed radially outward with respect to the longitudinal axis of the projectile under the influence of centrifugal force when the projectile rotates as it travels through the air.

It is also an object of the invention to enhance rotation of a weight-stabilized projectile by channeling air through a longitudinal passage such that the projectile adjusts itself to rotate about its longitudinal axis.

Furthermore, it is an object of the invention to provide a projectile capable of being easily and inexpensively produced.

These and other objects and attributes are achieved with the projectile of the present invention. The projectile is defined by a body symmetrical about a major axis and is characterized by movable weight means disposed on the body symmetrical both to the major axis and to a minor axis disposed transverse to the major axis. The weight means is adapted for movement in a radial outward direction with respect to the major axis when acted upon by centrifugal force imposed on the projectile as it rotates when travelling through the air. The weight means is adapted to automatically assume an equal weight distribution around the projectile in its radial outward position to cause the projectile to rotate in a spiral with its longitudinal axis aligned with the direction of projectile travel.

BRIEF DESCRIPTION OF THE DRAWINGS

The above and still further objects, features and advantages of the present invention will become apparent upon consideration of the following detailed description of specific embodiments thereof, especially when taken in conjunction with the accompanying drawings wherein like reference numerals in the various figures are utilized to designate like components, and wherein.

Figure 5:
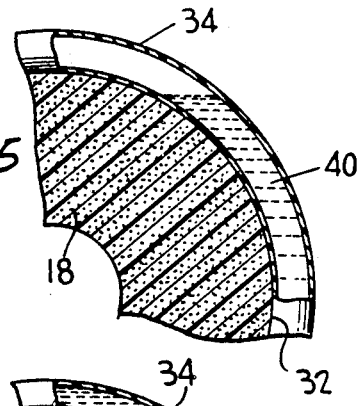
Figure 6:
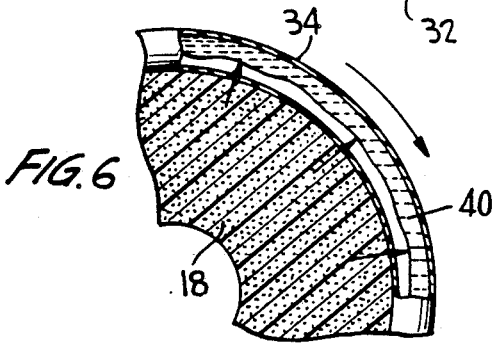

FIG. 5 is a fragmentary transverse cross-sectional view of an alternative embodiment for the projectile as it appears when at rest; and FIG. 6 is a fragmentary transverse cross-sectional view of the embodiment of FIG. 5 showing the projectile as it appears spinning when travelling through the air.

DESCRIPTION OF THE PREFERRED EMBODIMENT

A preferred embodiment for the aerial projectile of the present invention is described in conjunction with a game ball illustrated in FIGS. 1–4. The game ball includes a body 10 having a prolate spheroid configuration, such as that for a football, with a central longitudinal or major axis 12 and a lateral plane 14 containing a minor axis and disposed transverse to and bisecting the longitudinal axis. Longitudinal axis 12 is longer than lateral axis in plane 14 and defines an axis of rotation for the game ball when it is manually thrown through the air by the hand of the user or player.

Body 10 includes a lightweight, pliable and easily molded outer casing 16. Preferably, casing 16 is fabricated from a lightweight, low density plastic material coated with or formed of a low coefficient of friction material to reduce air drag when the game ball is thrown through the air. A lightweight material 18 having low density, such as a foam or sponge rubber, fills casing 16. The game ball is thus easily manipulable by a wide variety of users to provide ease of handling by persons of virtually all ages and physical strengths.

Figure 2:
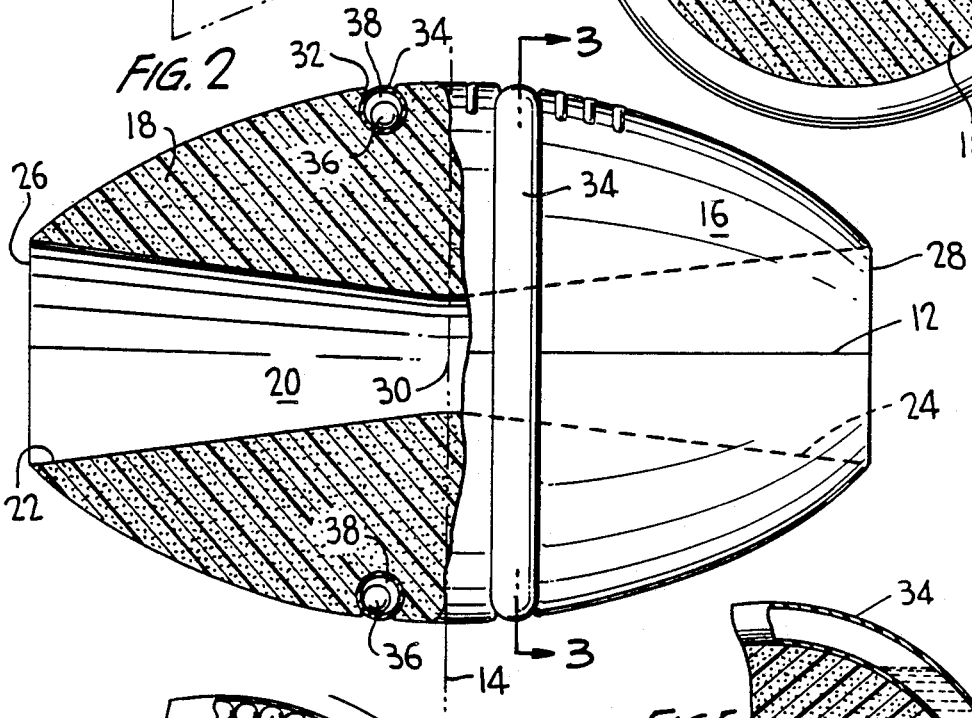
FIG. 2 is an enlarged side view in elevation and partial section of the projectile of FIG. 1.

An air passage 20 defined by frusto-conical walls 22 and 24 extends longitudinally within the body 10 from an opening 26 in one end of the body to an opening 28 in the opposite end of the body. Passage 20 is coaxial with the longitudinal axis 12 of the body and is symmetrical about lateral plane 14. As depicted in FIG. 2, passage 20 has a venturi-like configuration with a constriction 30 disposed at the lateral plane 14 such that the transverse cross-sectional area of openings 26 and 28 is greater than the transverse cross-sectional area of constriction 30. Although passage 20 is illustrated as being defined by frusto-conical walls 22 and 24, the passage can assume any desired configuration with the cross section thereof being inconstant or varying along the longitudinal axis 12 to channel air through the body 10.

In a typical football type game ball according to the invention, the width of the game ball as measured by the outermost diameter coincident with the transverse plane 14 is approximately seventy percent of the length of the ball as measured by the distance from opening 26 to opening 28 along longitudinal axis 12. The diameter of openings 26 and 28 in turn is approximately thirty-three percent of the width of the ball and the constriction 30 is approximately fifty-three percent of the diameter of openings 26 and 28.

A pair of circumferential grooves 32 are formed in the exterior of body 10. The grooves 32 are disposed in parallel planes perpendicular to longitudinal axis 12, parallel to lateral plane 14 and symmetrical with respect to lateral plane 14. In other words, each of the grooves is located the same distance from the lateral plane 14 but on opposite sides thereof. Additionally, the distance of the grooves from lateral plane 14 is such that the grooves are located within the middle one third of the length of the ball as measured along the longitudinal axis 12 from opening 26 to opening 28 of body 10.

Figure 1:
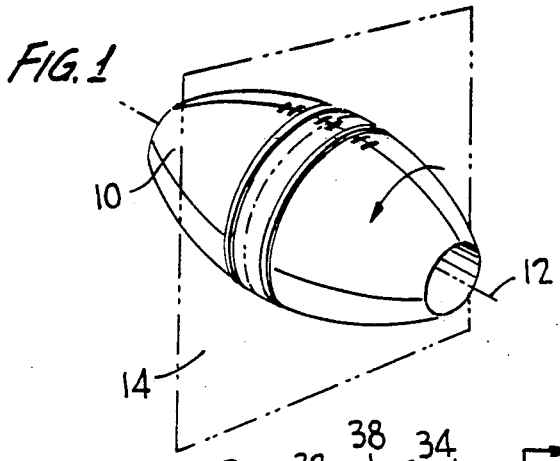
FIG. 1 is a perspective view of a projectile according to the present invention.
Figure 3:
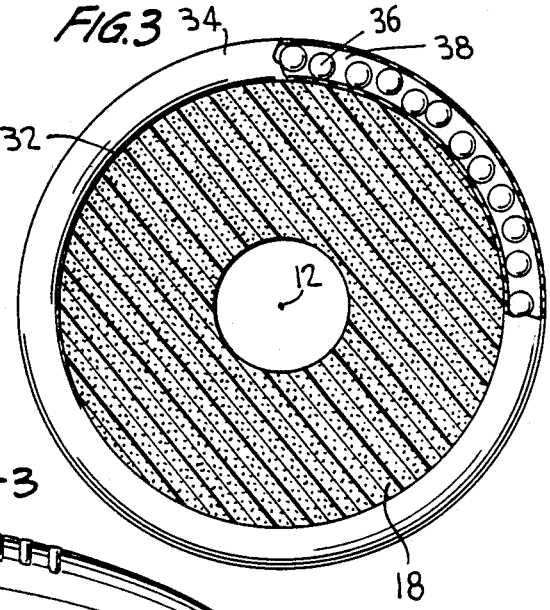
FIG. 3 is a transverse cross-sectional view of the projectile taken along line 3—3 of FIG. 2 and showing the projectile as it appears in a non-air-borne position.

A hollow tubular ring 34 is received in each groove 32, being formed of plastic or a similar resilient material capable of encircling body 10. A plurality of weighted beads 36 are contained within each of the rings 34. The beads 36 are spherical in configuration and have a diameter smaller than the inner diameter of the rings 34, which in the preferred embodiment have a circular cross-sectional configuration, so that there is a diametric clearance 38 between the beads 36 and the surrounding ring 34. Preferably, the diameter of each of the beads 36 is approximately sixty-five to seventy percent of the inner diameter of the ring 34 so that approximately thirty to thirty-five percent of the inner diameter of the ring serves as clearance for the beads. Thus, the beads 36 are free to move radially within rings 34 to the extent afforded by clearance 38. The number of beads 36 within the rings 34 may vary, depending upon the size and weight of the beads and the rings. It is preferred that the combined weight of the beads and rings be approximately thirty to fifty percent of the total weight of the projectile. Thus, more or less beads may be provided within the rings in certain instances and the distance between the side edges of adjacent beads in a singular ring will therefore vary depending upon the number of beads within the ring. The particular number of the beads determines the space between adjacent beads and the freedom of angular movement for the beads with respect to each other in establishing contact between adjacent beads. FIG. 3 illustrates a typical arrangement for beads 36 within ring 34 when the projectile is not air-borne, showing the random allocation of the beads within the ring as provided for by clearance 38 and by the space between adjacent beads. The exact allocation of the beads within the ring at any given moment will vary depending upon the particular orientation of the projectile. Were the projectile of FIG. 3 to be truly stationary, the beads 36 would be drawn by gravity toward the bottom of the projectile until the beads were in end to end relationship with no spaces between adjacent beads. A single space would then be established in the ring at the top of the projectile, the exact size of the space being determined by the number or density of the beads. Upon movement of the projectile from the stationary position, the beads would again assume a random arrangement depending upon the direction of movement of the projectile. Although the beads 36 are free to move both radially and angularly within the rings 34, it should be noted that only radial movement of the beads is required for the present invention. It would thus be possible, for example, to provide individual compartments for each of the beads whereby the beads are confined against movement in all but the radial direction.

Figure 4:
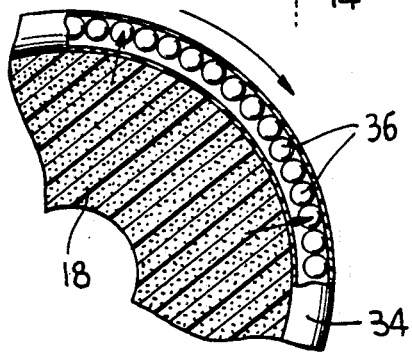
FIG. 4 is a fragmentary transverse cross-sectional view of the projectile taken along line 3—3 of FIG. 2 and showing the projectile as it appears when spinning as it travels through the air.

When the projectile is thrown, it is typically spun about axis 12 by the thrower. The rate of rotation of the projectile increases from the time it is released as it travels through the air. As the rate of rotation of the projectile increases, the beads 36 are automatically forced radially outward to the outside of the projectile and space themselves equally within the rings 34 against the outermost inner diameter surface of the ring under the influence of centrifugal force as depicted in FIG. 4. The beads being forced radially outward to the outermost inner diameter surface of the rings causes the projectile to straighten for a true spiral rotation with the longitudinal axis 12 aligned with the direction of the throw so as to obtain optimum flight distance and precision.

An alternative embodiment for the invention is shown in FIGS. 5 and 6. The projectile depicted in FIGS. 5 and 6 is essentially the same as the projectile discussed in conjunction with FIGS. 1–4 except that rings 34 contain a non-toxic liquid 40 with approximately ten percent to fifteen percent of each ring being void of liquid. Preferably, the combined weight of the rings and liquid is approximately thirty percent to fifty percent the total weight of the projectile. When the projectile is at rest, as shown in FIG. 5, the liquid is drawn by gravity toward the bottom of the projectile, creating a space within the rings at the top of the projectile corresponding to the particular percentage of the ring having no liquid. As depicted in FIG. 6, when the projectile rotates upon being thrown into the air, the liquid 40 is directed radially outward to the outermost inner surface of the ring 34 by centrifugal force in the manner discussed in connection with beads 36 of FIGS. 1–4. The weight of the liquid against the outer surface of the inner diameter of the tube causes the projectile to rotate in a true spiral with its longitudinal axis aligned with the direction of the throw.

In addition to the beads 36 and liquid 40 particularly described herein, the rings 34 may be provided with other types of weight means capable of being automatically directed in a radial direction when the projectile spins. Indeed, the weight means may be formed as an integral part of the rings themselves, one example of such being a radially collapsed tube having a weighted outer portion. When the projectile rotates upon being thrown through the air, centrifugal force causes the tube to open with the weighted outer portion directed radially outward to optimize the distance and accuracy of the throw. Regardless of the particular weight means adopted, the rings 34 need not be received in recesses 32, but may be mounted directly upon the outer casing 16. Additionally, although rings 34 have a circular cross-section, other cross-sections may be utilized, and the rings may be formed from tubes having rectangular, triangular and oval cross-sectional configurations. Furthermore the invention is not limited to a game ball and is equally adaptable to other projectiles such as hand grenades, shells and the like.

Although the invention has been described in conjunction with longitudinal passage 20, it should be noted that the beneficial results realized with the weighted rings are not dependent upon the presence of passage 20 and such need not be provided. The channeling of air through passage 20 does, however, assist in correcting for imprecisions in the release of the projectile in assuring its rotation about the longitudinal axis and in maximizing its flight path, the attributes of passage 20 being set forth in greater detail in our U.S. Pat. Nos. 4,003,574 and 3,884,466.

Having described a preferred embodiment of a new and improved flight stabilized projectile constructed in accordance with the present invention, it is believed that other modifications, variations and changes will be suggested to those skilled in the art in view of the teachings set forth herein. It is therefore to be understood that all such variations, modifications and changes are believed to fall within the scope of the present invention as defined by the appended claims.

What is claimed is:

1. A projectile adapted to be thrown through the air comprising:

a body substantially symmetrical about a major axis and a minor axis;

movable flight stabilization means on said body at opposite sides of the minor axis in planes parallel to and symmetrical about the minor axis, said stabilization means being of sufficient weight to be flung radially outward with respect to the major axis in response to centrifugal force when said projectile is thrown through the air with spin about said major axis.

2. A projectile as recited in claim 1 wherein said stabilization means is located within the middle one third of the major axis.

3. A projectile as recited in claim 1 wherein said stabilization means includes: an enclosed chamber encircling said body, and weighted means disposed within said chamber and movable radially outward within said chamber with respect to the major axis.

4. A projectile as recited in claim 3 wherein said enclosed chamber is an endless tube and said weighted means is a plurality of beads.

5. A projectile as recited in claim 4 wherein said tube is circular in cross-section and said beads are spherical, the diameter of said beads being approximately sixty-five percent to seventy percent of the inner diameter of said tube.

6. A projectile as recited in claim 3 wherein said enclosed chamber is an endless tube and said weighted means is a liquid.

7. A projectile as recited in claim 6 wherein said liquid fills approximately eighty-five percent to ninety percent of said tube.

8. A projectile as recited in claim 1 wherein the weight of said stabilization means is approximately thirty percent to fifty percent of the total weight of said projectile.

9. A projectile as recited in claim 1 further comprising a longitudinal bore extending through said body to define an air passage of varying cross-section.

10. A projectile adapted to be manually thrown through the air comprising:

a body having a prolate spheroid configuration substantially symmetrical about its major axis and minor axis;

movable weight means on said body in planes parallel to and symmetrical about the minor axis and lying substantially along the middle one third of the major axis, said weight means being movable at least in a direction radially outward from the major axis under the influence of centrifugal force created when said body is thrown through the air with spin about said major axis, whereby said weight means is distributed equally around said body as said body travels through the air.

11. A projectile as recited in claim 10 wherein said movable weight means includes: an enclosed chamber encircling said body, and weighted material disposed within said chamber and movable radially outward within said chamber with respect to the major axis.

12. A projectile as recited in claim 11 wherein said enclosed chamber is an endless tube and said weighted material is a plurality of beads.

13. A projectile as recited in claim 12 wherein said enclosed chamber is an endless tube and said weighted material is a liquid.

14. A projectile as recited in claim 10 further comprising a Venturi nozzle passage extending through said body concentrically about said major axis.

15. A game ball adapted to be manually thrown through the air comprising:

a body having a prolate spheroid configuration substantially symmetrical about a major axis and a minor axis disposed transverse to the major axis;

a longitudinal bore extending through said body to define an air passage symmetrical about both the major axis and the minor axis, said air passage having a maximum cross-sectional area at opposing longitudinal ends of said body and continuously decreasing to a minimum cross-sectional area at substantially the midpoint between said opposing ends; and movable weight means provided on said body in planes oriented parallel to and disposed symmetrically about the minor axis, said weight means being movable at least in a direction radially outward from the major axis under the influence of centrifugal force created when said body is thrown through the air with spin about said major axis, whereby said weight means is distributed evenly around said body in a radial direction as said body travels with spin through the air.

16. A game ball as recited in claim 15 wherein said movable weight means includes first and second tubes each having a circular cross-section encircling said body, said tubes being disposed on respective opposite sides of the minor axis, and a plurality of spherical beads disposed within said tubes.

17. A game ball as recited in claim 16 wherein first and second annular recesses are defined in the exterior of said body and said first and second tubes are received within said first and second recesses, respectively.

18. A game ball as recited in claim 15 wherein said movable weight means includes first and second tubes each encircling said body on respective opposite sides of the minor axis, and a non-toxic liquid contained in said tubes.

19. A game ball as recited in claim 18 wherein first and second annular recesses are defined in the exterior of said body and said first and second tubes are received within said first and second recesses, respectively.

20. A game ball as recited in claim 15 wherein said body has an outer skin fabricated of a lightweight, low density plastic material and an interior fabricated of a lightweight, low density sponge rubber material.

* * * * *